United States Patent [19]

Cadoff

[11] 4,016,446

[45] Apr. 5, 1977

[54] REFRACTORY-OXIDE-BASED INCANDESCIBLE RADIATORS AND METHOD OF MAKING

[75] Inventor: Laurence H. Cadoff, Pittsburgh, Pa.

[73] Assignee: Westinghouse Electric Corporation, Pittsburgh, Pa.

[22] Filed: Jan. 31, 1975

[21] Appl. No.: 546,152

[52] U.S. Cl. ..... 313/218; 29/25.17; 75/207; 75/.5 R; 313/222; 313/345; 106/65; 106/66

[51] Int. Cl.[2] ..... H01K 1/10

[58] Field of Search ..... 313/222, 341, 345, 218, 313/315; 29/25.17, 182, 182.5; 75/207

[56] References Cited

UNITED STATES PATENTS

| | | | |
|---|---|---|---|
| 2,845,515 | 7/1958 | Anderson et al. | 313/345 X |
| 3,278,281 | 10/1966 | Ehringer | 75/207 X |
| 3,475,159 | 10/1969 | Hansen | 75/207 X |
| 3,853,491 | 12/1974 | Dunham | 75/207 X |

*Primary Examiner*—Palmer C. Demeo
*Attorney, Agent, or Firm*—W. D. Palmer

[57] ABSTRACT

Refractory-oxide-based elongated incandescent radiator has a body portion which principally comprises refractory oxide with from about 8 volume percent to 20 volume percent of refractory metal dispersed therein. Such members are normally not sufficiently conducting to enable them to be self-resistance heated to a condition of incandescence. The room-temperature conductivity of such a member is greatly increased by heating the initially sintered member during fabrication thereof to a temperature of at least about 1400° C while simultaneously subjecting the heated member to the influence of an electric field having an intensity of at least about 5 volts/mm. The completely processed members can be self-resistance heated to a condition of incandescence without the use of supplemental heaters. In its preferred form the radiator carries thereon a thin oxide coating, in order to improve the visible-radiation-emission characteristics. These radiators have utility as incandescent elements in light sources.

13 Claims, 3 Drawing Figures

REFRACTORY-OXIDE-BASED INCANDESCIBLE RADIATORS AND METHOD OF MAKING

CROSS-REFERENCE TO RELATED APPLICATION

In copending application Ser. No. 546,058 filed concurrently herewith titled "Incandescent Source of Visible Radiations" by R. W. Warren and D. W. Feldman and owned by the present assignee, now U.S. Pat. No. 3,973,155, there is disclosed an incandescent source of visible radiations which in its preferred form comprises a doped refractory oxide which is an excellent radiator for visible radiations and is highly transmissive for infrared radiations. When such material is formed as a particulate layer on a substrate, the generated visible radiations are emitted from the radiator and the infrared radiations are scattered back to the substrate. Such a particulate layer is particularly adapted for coating onto a substrate formed of the cermet as disclosed in the present application.

BACKGROUND OF THE INVENTION

This invention relates to refractory-oxide-based cermets and method and, more particularly, to refractory-oxide-based elongated incandescent radiators which are particularly adapted for use as light sources which can be self-resistance heated to a state of incandescence, and to methods for making same.

Refractory-oxide-based incandescent members which are particularly adapted for use as lamp filaments are known, such as described in U.S. Pat. No. 3,412,286, dated Nov. 19, 1968. The refractory oxide radiators are potentially superior to tungsten with respect to spectral emission characteristics. Practical application of such members in lamps has been impeded by several properties of oxide ceramics such as very low electrical conductivity at room temperatures, a positive temperature coefficient of conductivity, and poor thermal shock resistance. Attempts to overcome these difficulties have included the use of preheaters to raise the ceramic into its self-conducting temperature range, ballasts to stabilize the filament current and prevent current "run-away", and carefully controlled heat-up and cool-down rates to minimize thermally shocking the elements to prevent their fracture.

SUMMARY OF THE INVENTION

In accordance with the present invention there is provided a refractory-oxide-based elongated incandescent radiator which is adapted for operation by application of a predetermined potential across the ends thereof. In its preferred form, the radiator comprises an elongated sintered member having a body portion principally comprising refractory oxide which in a pure state appears generally light in color. Dispersed throughout the oxide are discrete refractory metal particles present in amount from about 8 volume percent to about 20 volume percent of the body portion. These dispersed refractory metal particles have sufficient electrical continuity therebetween to enable the radiator to be self-resistance heated to an incandescent state by application of the predetermined operating potential across the ends thereof. Because of the metal particles, the radiator body portion has a gray color, which impairs its overall visible-radiation emission efficiency. In order to provide the body portion with lighter appearance, there is provided thereover a thin sintered layer of the oxide. A preferred refractory oxide used for the radiator is chromia-doped alumina.

The low-temperature conductivity of the radiator body portion is due to the processing techniques which are used in the preparation of same. Normally, a sintered refractory body with up to about 20 volume percent of discrete refractory metal particles dispersed therein would have sufficient resistivity that the member could not be self-resistance heated to a condition of incandescence upon application of a normal operating potential across the ends thereof. In order to increase the conductivity of the member, the member is initially sintered to a density which is from about 75% to 86% of theoretical density. The member is then heated to a temperature of at least about 1400° C and simultaneously placed within the influence of an electric field having an intensity of at least about 5 volts/mm. This simultaneous application of heat and electric field causes the discrete refractory metal particles to have sufficient electrical continuity therebetween to enable the member to be self-resistance heated to an incandescent state. After treatment to increase the conductivity, the member preferably is provided with a thin oxide coating over its surface in order to improve the visible-radiation emission efficiency. In one method of obtaining such a coating, the sintered member is further heated in an oxidizing atmosphere to a temperature of at least about 1400° C which causes the refractory metal proximate the surface portion thereof to oxidize and then vaporize.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
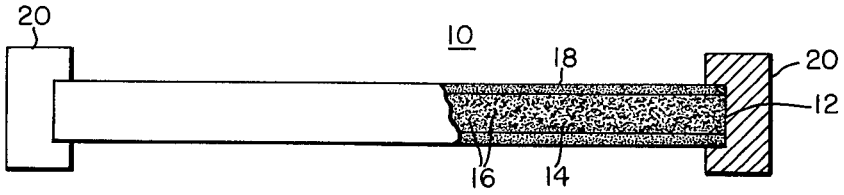
FIG. 1 is an enlarged elevational view, shown partly in section, illustrating a refractory-oxide-based, elongated, incandescent radiator fabricated in accordance with the present invention, along with the mounting means therefor.

With specific reference to the elongated, incandescent radiator 10 as shown in FIG. 1, it is adapted for operation by application of a predetermined electric potential, such as 110–120 volts, across the ends thereof in order to incandesce. The radiator is formed of an elongated body portion 12 which principally comprises sintered refractory oxide 14, which in a pure state appears generally light in color. Discrete refractory metal particles 16 are dispersed throughout the oxide in amount of from about 8 volume percent to about 20 volume percent of the body portion 12, and the dispersed refractory metal particles display therebetween sufficient electrical continuity to enable the radiator 10 to be self-resistance heated to an incandescent state upon application of 110–120 volts operating potential across the ends thereof. The presence of the refractory metal particles give the body portion 12 a gray appearance which impairs the overall efficiency of the generation of visible radiations and in order to improve same by minimizing the emission in the infrared region, there is provided over the body portion 12 a thin sintered layer 18 of the same oxide, which layer 18 overlies and is adhered to the body portion 12. Refractory metal mounting members 20, which can be fabricated of tungsten, overfit the ends of the radiator 10.

The refractory oxide can be selected from a large group such as those comprising doped or undoped thoria, hafnia, alumina, calcia, zirconia, or magnesia and the refractory metal can be molybdenum, tungsten, tantalum, or niobium. Preferred refractory oxides are ceria-doped thoria or chromia-doped alumina, with the doping constituent present in amount of 1% to 2% by weight. The preferred refractory metal is tungsten. Chromia-doped alumina is quite transmissive in the infrared region nd absorptive in the visible range. If this material is adhered as a thin particulate layer to a substrate, in accordance with the teachings set forth in said copending application Ser. No. 546,058, filed concurrently herewith there is produced a very efficient source of incandescent radiations. In accordance with the teachings in the present application, the refractory oxide substrate may be made conducting so that it can be heated by application of an electric potential thereacross. A thin particulate layer of chromia-doped alumina adhered to such a conducting cermet provides a very efficient source of incandescent radiations. Chromia-doped alumina can be prepared by mixing 98 weight percent finely divided alumina with 2 weight percent finely divided chromia and the mixture is dry ball-milled for 16 hours. The mixture is then fired at 1700° C in an oxidizing atmosphere to form the chromia-doped alumina.

Figure 2:
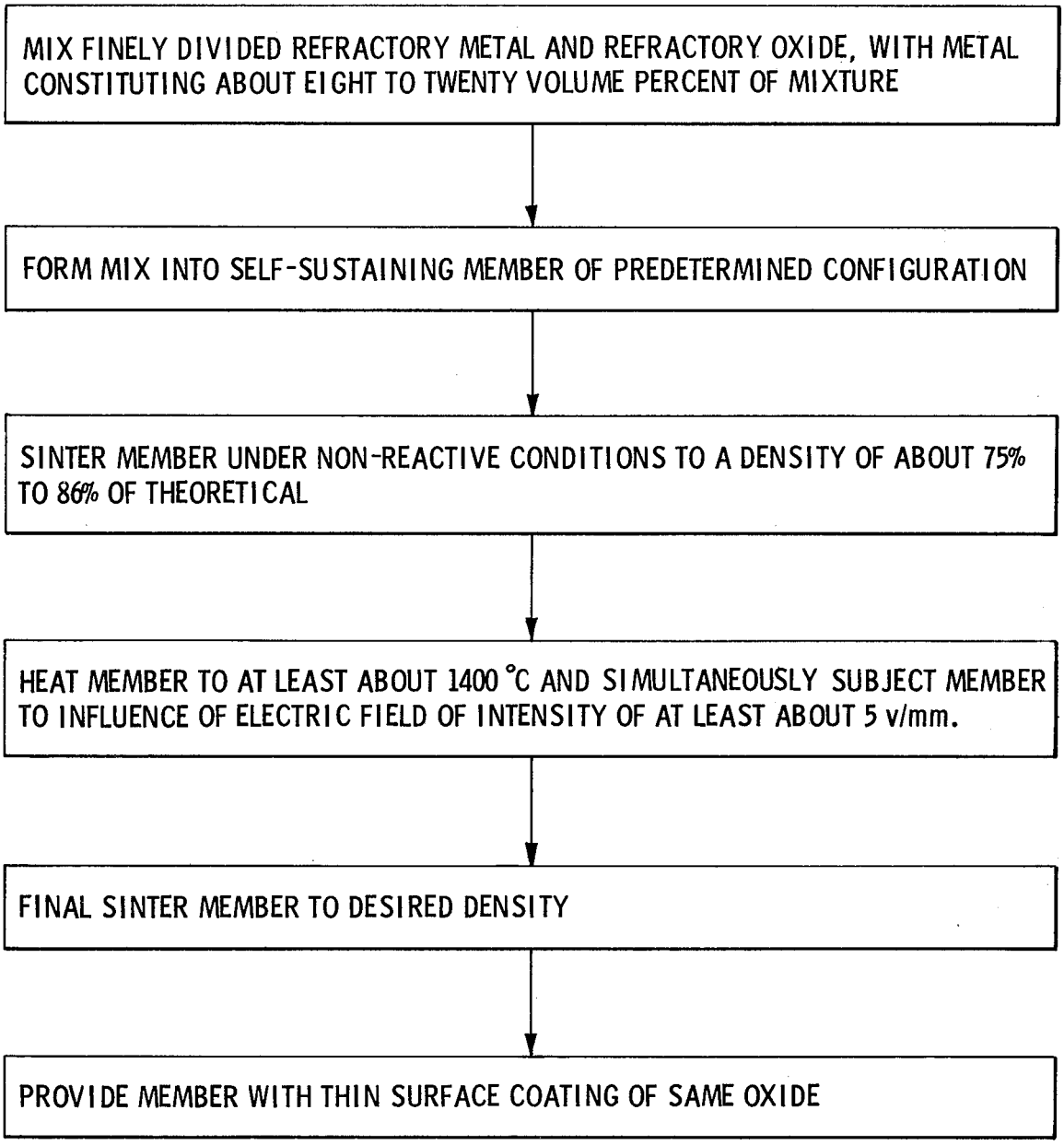
FIG. 2 is a flow diagram illustrating the steps used to prepare the radiator.

In preparing the radiator in accordance with the flow diagram as shown in FIG. 2, there is first mixed finely divided refractory metal and finely divided refractory oxide, with the metal consituting about 8 to 20 volume percent of the mixture. The state of division of the oxide and metal is not critical, although they preferably are reasonably similar in size. As an example, the refractory oxide has a particle size averaging about 7 microns and the tungsten has a particle size averaging about 5 microns. The mix is then formed into a self-sustaining member of predetermined configuration and the preferred method for forming the filamentary member is to use what is known as "tape" technology. In accordance with this technique, polyvinyl butyrate resin in amount of 6% by weight of the mixed powder has added thereto a plasticizer such as triethylene glycol di-2-ethylhexoate in amount of about 6% by weight of the powder, plus sufficient solvent such as toluene and isopropanol (60:40 weight ratio) to provide the mixture with the consistency of thick dough. This mix is then extruded through a 36 mil orifice using a pressure of approximately 18,000 psi. This produces an elongated member of the desired diameter, which member is quite flexible and can be readily handled. The member is positioned in the predetermined configuration desired for the filament such as straight, curved, or coiled. The member is then slowly heated at a rate of about 75° C per hour up to a temperature of approximately 500° C in a wet hydrogen atmosphere, in order to volatilize the binder and set the configuration for the filamentary member. If desired, the filament can be formed as a flat ribbon in order to increase the radiating area.

In the next processing step, the set member is rapidly heated to a temperature of at least about 1400° C and preferably about 1600° C to 1700° C and maintained at this temperature for approximately 1 hour, with the atmosphere being wet hydrogen. This provides an initial sintering of the radiator and its density will be from about 75% to about 86% of theoretical density.

In the next step of preparation, the resulting cermet is heated in an argon or nitrogen atmosphere, or a mixed argon-nitrogen atmosphere, at a temperature of at least about 1400° C, and preferably about 1600° C, while simultaneously subjecting the cermet member to the influence of an electric field having an intensity of at least about 5 volts/mm but insufficient to cause the member to fracture. At a specific example, the cermet member is heated at a temperature of 1600° C for 2 to 3 minutes while clamped between electrodes and applying thereacross a 60 cycle electric field having an intensity of 7 to 9 volts (rms)/mm.

The foregoing simultaneous application of heat and electric field substantially increases the room temperature conductivity of the cermet. As an example, with a thoria-tungsten cermet system, room temperature resistivities of approximately 5 times $10^{-1}$ and 1 times $10^{-2}$ ohm-cm has been obtained for 8 volume percent tungsten and 20 volume percent tungsten material, respectively. In contrast, identical materials which had not been so treated would display room temperature resistivities greater than $10^5$ ohm-cm.

In the final step of preparing the body portion of the radiator, the now-conducting material is final sintered at a temperature which at least approximates the temperature at which it is intended to be operated to provide an incandescent source. As an example, if the thoria-tungsten radiator is intended to be operated at 2000° C, it can be sintered in a hydrogen or inert atmosphere at a temperature of approximately 2100° C for approximately 45 minutes in order to provide a final densification. As an example, a final suitable density for the sintered material is greater than 90% of theoretical.

Because of the incorporation of the dark colored refractory metal into the normally light colored refractory oxide, the resulting cermet has a gray color which increases greatly its emission in the near infrared. In order to reduce same by restoring the generally light body color to the sintered member, additional oxide of the same composition as the body portion is formed into a slurry with a suitable vehicle such as toluene and the slurry is sprayed over the formed member to a suitable thickness such as 50 microns, for example. The coated member is then sintered in the wet hydrogen atmosphere at a temperature similar to the final sintering temperature for the body portion and this will provide the adherent, generally light appearing, overlying layer 18, as shown in FIG. 1.

As an alternative method for forming the separate overlying layer of refractory oxide, the final-sintered body portion of the incandescent radiator can be heated in an oxidizing atmosphere at a temperature of at least about 1400° C, which causes the tungsten particles proximate the surface of the member to oxidize and then vaporize, leaving a layer 18 of sintered refractory oxide overlying the cermet body 12.

Figure 3:
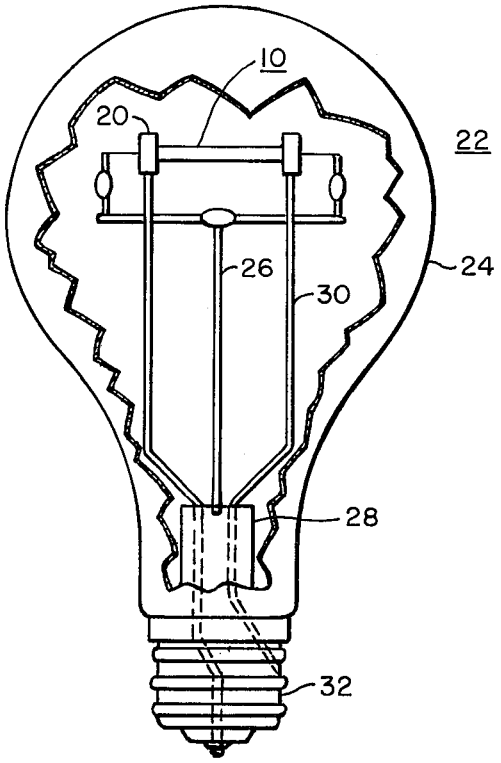
FIG. 3 is an elevational view, partly broken away, illustrating an incandescent light source which incorporates an incandescent radiator fabricated in accordance with the present invention.

In FIG. 3 is shown an incandescent light source 22 which incorporates the filamentary radiator 10 as shown in FIG. 1. Briefly, this light source 22 comprises the radiator 10 which is operatively positioned and supported within a light transmitting envelope 24 by means of suitable support leads 26 which extend from the conventional stem-press portion 28. Electrical lead-in conductors and supports 30 connect to the tungsten contact members 20 and thus to the ends of the incandescent radiator 10 and in turn are sealed through the stem-press 28 and connected to the base 32, to permit energization of the radiator body to an incandescent condition. The envelope 24 encloses an atmosphere suitable for sustaining the operation of the radiator body, examples being nitrogen or inert gas. As an example, for operation at 110–120 volts, the radiator 10 is formed of 15 to 20 volume percent tungsten in ceria-doped thoria or chromia-doped alumina. The length of the radiator is 2.9 cm and the body portion thereof has a diameter of 0.55 mm.

Because of the relatively small volume percent of the refractory metal which is incorporated into the cermet, the thermal shock resistance is quite good. Because of the presence of the dispersed metal component, there are no particular restrictions on filament heating rate or filament cooling rate. Due to the relatively low levels of metal additives in the cermet, good thermal expansion matches are provided in the coatings which overlie the cermet, in order to tailor the spectral emission characteristics as described hereinbefore. In addition, because of the conditioning treatment whereby the simultaneous application of the field and heat improves the conductivity of the cermet, the resulting filamentary member can be self-resistance heated to a condition of incandescence without the need for some supplemental preheating system. Particularly at the higher levels of 15 volume percent to 20 volume percent tungsten, a positive temperature coefficient of resistivity can readily be achieved, even at operating temperature greater than 2100° C, thereby eliminating any need for an external ballast and simplifying the design of the lamp.

The mechanism by which the increase in conductivity is obtained is not thoroughly established although it is clear that the conductivity of the conditioned or treated cermets is metallic. Apparently, the simultaneous application of field and heat causes small, scattered electric discharges to occur within the body of the cermet which in turn tends to vaporize small portions of the discrete particles. As a result, metallic atoms are scattered between the particles and deposited onto the ceramic refractory oxide, thereby increasing the electrical conductivity through the resulting cermet.

I claim as my invention:

1. A refractory-oxide-based elongated incandescent radiator body member adapted for operation by application of a predetermined electric potential across the ends thereof, said body member comprising:

a. an elongated member principally comprising sintered refractory oxide which in a pure state appears generally light in color;

b. discrete refractory metal particles dispersed throughout said oxide in amount of from about 8 volume percent to about 20 volume percent of said member, and said member as initially sintered during fabrication thereof having sufficient resistivity that said member will not self-resistance heat to a condition of incandescence upon application of said predetermined electric potential across the ends thereof;

c. said member having been further processed after being initially sintered by heating said member under non-reactive conditions to a temperature of at least about 1400° C while simultaneously placing said member within the influence of an electric field having an intensity of at least about 5 volts/mm but insufficient to cause said member to fracture; and d. said simultaneously heating and application of said field causing said discrete metal particles to have therebetween sufficient electrical continuity to enable said member to be self-resistance heated to an incandescent state upon application of said predetermined electric potential across the ends thereof.

2. The radiator body member as specified in claim 1, wherein said refractory oxide comprises thoria, hafnia, alumina, calcia, zirconia or magnesia, and said refractory metal is tungsten, molybdenum, tantalum or niobium.

3. A refractory-oxide-based elongated incandescent radiator body member adapted for operation by application of a predetermined electric potential across the ends thereof, said body member comprising:

a. an elongated member principally comprising sintered ceria-doped thoria or chromia-doped alumina refractory oxide which in a pure state appears generally light in color;

b. discrete refractory metal tungsten particles dispersed through said oxide in amount of from about 8 volume percent to about 20 volume percent of said member, and said member as initially sintered during fabrication thereof having sufficient resistivity that said member will not self-resistance heat to a condition of incandescence upon application of said predetermined electric potential across the ends thereof;

c. said member having been further processed after being initially sintered by heating said member under non-reactive conditions to a temperature of at least about 1400° C while simultaneously placing said member within the influence of an electric field having an intensity of at least about 5 volts/mm but insufficient to cause said member to fracture; and d. said simultaneously heating and application of said field causing said discrete metal particles to have therebetween sufficient electrical continuity to enable said member to be self-resistance heated to an incandescent state upon application of said predetermined electric potential across the ends thereof.

4. The radiator body member as specified in claim 3, wherein said member is initially sintered to a density which is about 75% to 86% of theoretical, and after said simultaneous heating and application of said field, said member is final sintered at a temperature which is at least equal to the temperature at which said member is intended to be operated.

5. The radiator body member as specified in claim 4, wherein during further processing thereof after initial sintering said member is heated to a temperature of from about 1600° C to about 1700° C while simultaneously applying thereacross an electric field having an intensity of about 7 to 9 volts per mm.

6. The radiator body member as specified in claim 4, wherein said member has been further treated after final sintering by heating same in an oxidizing atmosphere at a temperature of at least about 1400° C to oxidize and vaporize those of said refractory metal particles which are proximate the surface thereof, whereby said refractory oxide proximate the surface of said member has improved visible-radiation-emissive characteristics.

7. The radiator body member as specified in claim 3, wherein said member has been further treated after final sintering by applying to the surface of said member a thin powder coating of the same of said refractory oxide which principally comprises said member, and said thin powder coating and said member are then sintered under non-reactive conditions to cause said coating to sinter as a layer to the surface of said member, whereby said member has improved visible-radiation-emissive characteristics.

8. The radiator body member as specified in claim 6, wherein said radiator body member is operatively positioned and supported within a light-transmitting envelope means, an atmosphere suitable for sustaining the operation of said radiator body member is enclosed by said envelope means, and electrical lead-in conductors connect the ends of said radiator body member and are sealed through said envelope means to permit energization of said radiator body member to an incandescent condition.

9. The method of preparing a cermet body which will display increased electrical conductivity at room temperature, said method comprising:

a. preparing a mixture of finely divided refractory oxide and finely divided refractory metal, with said refractory metal present in the amount of from about 8 volume percent to about 20 volume percent of said mixture;

b. forming said mixture into a self-sustaining member having a predetermined configuration which approximates that desired for said cermet body;

c. presintering said self-sustaining member under non-reactive conditions to provide said member with a density which is from about 75% to about 86% of theoretical;

d. treating said presintered member by heating said under non-reactive conditions at a temperature of at least about 1400° C while simultaneously subjecting said member to the influence of an electric field having an intensity of at least about 5 volts/mm but insufficient to cause said member to fracture; and e. final sintering said treated member under non-reactive conditions to achieve a desired density.

10. The method as specified in claim 9, wherein said refractory oxide comprises one of thoria, hafnia, calcia, zirconia, alumina and magnesia, and said refractory metal is tungsten, molybdenum, tantalum or niobium.

11. The method as specified in claim 10, wherein said refractory oxide is ceria-doped thoria or chromia-doped alumina and said refractory metal is tungsten.

12. The method as specified in claim 11, wherein said cermet body is further processed after final sintering by heating same in an oxidizing atmosphere at a temperature of at least about 1400° C to oxidize and thus vaporize refractory metal proximate the surface of said cermet body.

13. The method as specified in claim 11, wherein said body has been further treated after said final sintering by applying to the surface of said body a thin powder coating of the same said refractory oxide which principally comprisees said body, and said thin powder coating and said body are then sintered under non-reactive conditions to cause said coating to sinter as a layer to the surface of said body, whereby said body has improved visible-radiation-emissive characteristics.

* * * * *